US006706148B1

(12) United States Patent
Joisson et al.

(10) Patent No.: US 6,706,148 B1
(45) Date of Patent: Mar. 16, 2004

(54) METHOD FOR FIXING A MINERAL FILLER ON CELLULOSIC FIBERS AND METHOD FOR MAKING A SHEET OF PAPER

(75) Inventors: Didier Joisson, Sainte Croix en Plaine (FR); Christian Richard, Chambery (FR); Gilbert Schohn, Saint-Hyppolyte (FR); Cyrille Schu, Colmar (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 10/049,505

(22) PCT Filed: Jul. 24, 2000

(86) PCT No.: PCT/FR00/02123

§ 371 (c)(1),
(2), (4) Date: May 20, 2002

(87) PCT Pub. No.: WO01/12899

PCT Pub. Date: Feb. 22, 2001

(30) Foreign Application Priority Data

Aug. 13, 1999 (EP) ..... 99402058

(51) Int. Cl.[7] ..... D21H 11/00

(52) U.S. Cl. ..... 162/181.6; 162/181.7; 162/181.2; 162/183; 162/185; 162/158; 162/9

(58) Field of Search ..... 162/181.2, 181.6, 162/181.7, 183, 185, 158, 9

(56) References Cited

U.S. PATENT DOCUMENTS 6,406,594 B1 * 6/2002 Palmer et al. ..... 162/181.7

* cited by examiner

*Primary Examiner*—Peter Chin
*Assistant Examiner*—Mark Halpern
(74) *Attorney, Agent, or Firm*—Breiner & Breiner, L.L.C.

(57) ABSTRACT

The invention relates to a method for affixing a mineral filler onto an aqueous cellulose-fiber suspension. In this invention, the method uses as its reaction medium an aqueous cellulose-fiber suspension which is derived from papermaking and which includes at least hydrogen carbonates, carbonates or silicates of alkali and/or earth alkali metals, and the invention adds to the reaction medium a hydroxide of the filler mineral in order to precipitate the mineral filler's carbonates or silicates onto the fibers. In particular, the invention applies to papermaking.

9 Claims, 1 Drawing Sheet

Figure 1:
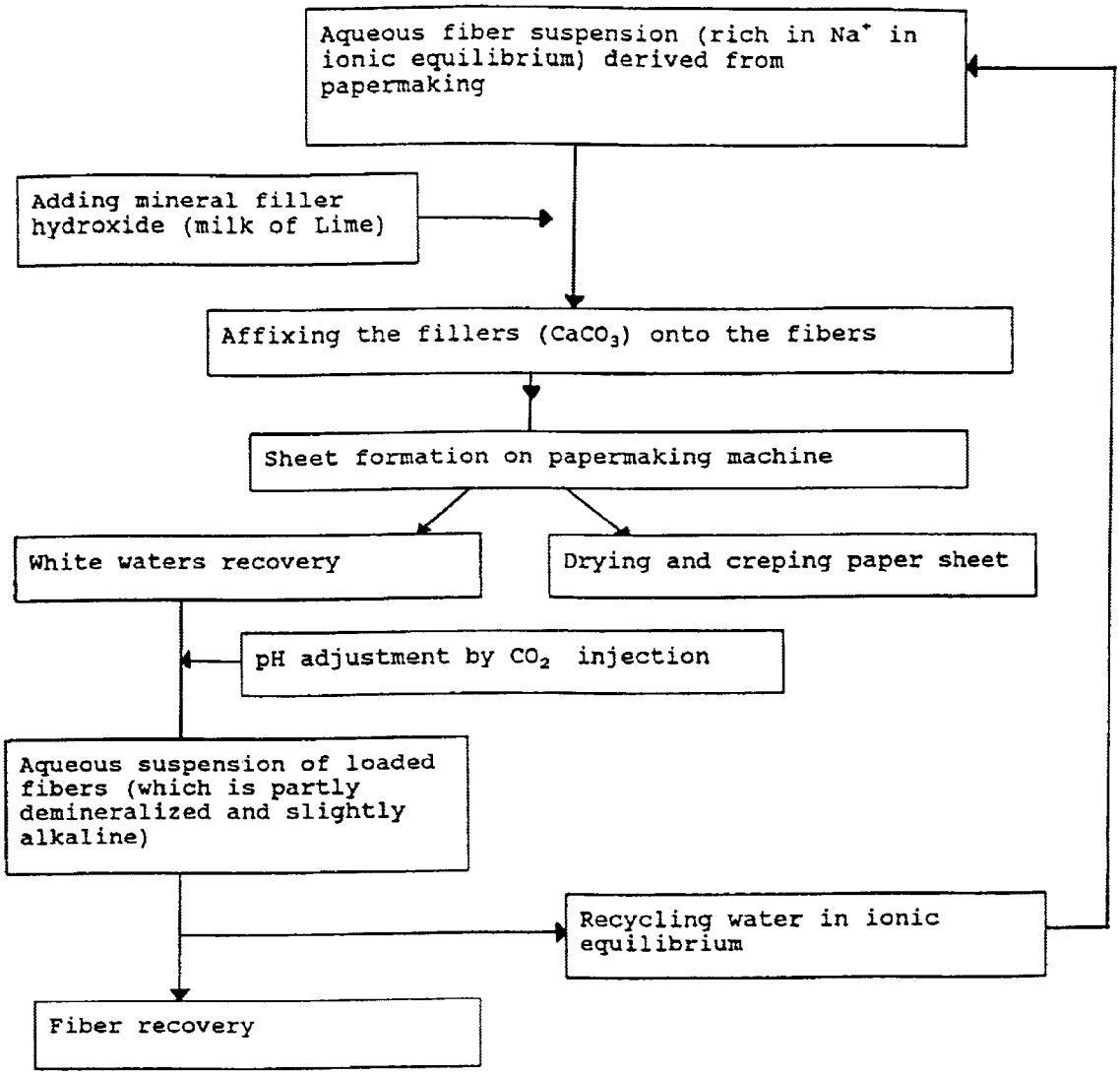

METHOD FOR FIXING A MINERAL FILLER ON CELLULOSIC FIBERS AND METHOD FOR MAKING A SHEET OF PAPER

The present method relates to a novel method for affixing mineral fillers onto cellulose fibers in aqueous suspension. For example, affixation of calcium mineral fillers onto fibers may be implemented by chemical reaction entailing the precipitation of an insoluble chemical compound, such as calcium carbonate, which affixes itself to the cellulose fibers and fibrils. The cellulose fibers onto which these mineral fillers have been affixed are used in paper manufacture.

This invention applies to the entire paper industry. It applies, for instance, to the manufacture of papers ordinarily containing mineral fillers, for example printing and writing paper such as coated paper, printers' paper such as newsprint, and lightweight coated paper (for magazines), and thin papers such as cigarette paper.

The invention also is applicable to manufacturing other kinds of paper such as sanitary and household papers that conventionally are free of mineral matters.

Cellulose fibers are short or long paper fibers. The aqueous fiber suspensions are prepared from an arbitrary pulp, namely chemical, bleached or unbleached, mechanical or thermomechanical pulps, or mixtures of these various pulps. Moreover, this pulp may also be derived by de-inking old papers or recycled papers.

Mineral fillers can be directly added to the manufacture of paper sheets.

Among the conventionally added mineral fillers, the most commonplace are the natural or synthetic calcium. carbonates ($CaCO_3$). They are added to paper fibers to improve the features of the paper products. The mineral fillers may impart various properties to the paper. Due to their crystal structure and their particular morphologies, they impart whiteness, opacity, improved thickness etc. to the paper. They are economically significant because lowering the costs of the raw materials is cheaper than fibers.

However, they entail a capital difficulty consisting in affixing these fillers onto the cellulose fibers and, in particular, in the weakness of the filler-fiber bond. Typically, the fillers will not maintain contact with the fibers when paper sheets are being made. The fine mineral particles tend to move away from the fiber pad constituted by each sheet and a portion of these particles collects, whether recovered and/or rejected in the processing waters.

This phenomenon is commonplace when making absorbent papers based on cellular cotton, i.e. papers of low specific surface weight manufactured at high speeds, either conventionally, that is being dried or creped, or using a cross-blowing drying method.

Also, when a portion of the fillers is retained in the fiber pad, these fillers will spread non-uniformly through the thickness of the paper sheet.

Already retention agents have been added to improve mineral charge retention at the fibers for the purpose of overcoming the above problem.

Numerous publications and prior patents since 1945 describe procedures for precipitating mineral fibers onto fillers for the purpose of improving the fibers' filler-retention and to avoid adding retaining agents. These procedures are based on such chemical reactions as addition or double decomposition. Some procedures in particular relate to precipitating mineral fillers into the hollow part of the fibers in order to preserve their mechanical properties and hence those of the paper, the properties generally being degraded by the fillers' presence.

As a rule, the affixation method consists in introducing into an aqueous solution containing a substantial concentration of fibers, a first reagent based on one of the cations constituting the future precipitate, for example, calcium oxide or hydroxide or slaked lime.

After diluting the aqueous solution containing concentrated fibers and calcium hydroxide, and in the manner of the procedures disclosed in Japanese and French patent applications, respectively, JP 60 297,382 A (Hohuetsu Seishi) and FR 2,689,530 B1 (Aussedat Rey), carbon dioxide is injected to precipitate the calcium hydroxide.

On the other hand, International Application WO 92/15754 proposes injecting carbon dioxide in pressurized form into contact with the aqueous solution containing a high concentration of fibers for the purpose of affixing the precipitates simultaneously inside, on the hollow inner parts and in the walls of the fibers.

Other patents or patent applications disclose more complex procedures based on calcium salts. An additional stage eliminates one of the reaction products of the double decomposition. This is the case for U.S. Pat. Nos. 4,510,020 (Green) and 2,583,548 (Graig).

The latter patent describes a procedure wherein first the fibers are impregnated with calcium chloride in order to react this salt with sodium carbonate and then the mixture is washed to eliminate its sodium chloride.

U.S. Pat. No. 3,029,181 (Thomsen) discloses a similar procedure using ammonium carbonate.

International Application WO 91/04138 discloses a large number of mineral fillers which can be precipitated by a procedure using a double decomposition reaction.

However, all known precipitation procedures that have been described to date entail chemical and physical means which in turn require auxiliary preparatory stages, such as solubilizing the reagents, diluting or concentrating the aqueous fiber suspensions, and filtering or washing, in order to allow precipitation.

The stages much harper paper manufacturing procedures.

Illustratively, peripheral industrial' equipment must be added to carry out the stages, namely mixing tubs, highly agitated, discontinuously operating reactors, filters, etc.

Such equipment is required on account of the frequently long chemical reaction times. As a result and in general, a production unit to prepare the filled fibers must be set up next to the conventional apparatus used in paper manufacture.

Consequently, the above described procedures of the prior art are infrequently used in industry and cannot compete with ex situ filler preparation.

Most of the present day manufacturing procedures still use previously prepared suspensions of minerals which are added to a suspension of fibers. In this case, the retaining agents are incorporated in order to retain the fillers on the fibers during paper manufacture.

The objective of the invention is to create a method allowing resolution of the problems of the prior art.

The objective of the invention is to eliminate adding retention agents and any accessory preparation stage for the purpose of integrating fillers "in-line" or "in situ" into the overall paper manufacturing method.

For that purpose, the invention's solution uses the waters of the paper manufacturing method as the reaction medium, that is, it uses the water contained in the aqueous fiber suspension, in the stage of affixing the mineral fillers onto the cellulose fibers.

Actually, the waters constitute a reservoir of ions and minerals which can precipitate.

Therefore, the invention involves using this reservoir of ions, which are in ionic equilibrium in the aqueous fiber suspension. The totality of the papermaking waters therefore constitute a single precipitation reaction medium.

In the description below, the waters are construed as "an aqueous solution of cellulose fibers resulting from paper making".

This new method allows integrating in-line the precipitation stage of the mineral fillers onto the fibers as applied to papermaking taken in its widest sense. However, the method uses any of its waters without processing them in a special way. This method is widely applicable industrially and circumvents using additional retention agents.

In an essential feature of the invention, the method affixing a mineral filler onto cellulose fibers in an aqueous solution includes using an aqueous suspension of cellulose fibers derived from papermaking and comprising at least hydrogen carbonates, or carbonates or silicates of alkali metals and/or earth alkali metals, as the reaction medium to which are added a hydroxide of the mineral filler in order to precipitate carbonates or silicates of the mineral filler onto the fibers.

In a preferred feature of the invention, the aqueous cellulose fiber suspension comprises sodium hydrogen carbonates.

In another feature of the invention, the aqueous cellulose fiber suspension furthermore contains calcium and/or magnesium hydrogen carbonates.

In another feature of the invention, the full alkalimetric titer of the aqueous suspension is between 2and 30° F.

In another feature of the invention, the mineral filler hydroxide is a calcium hydroxide.

Another object of the invention is a papersheet manufacturing process.

In an essential feature of the invention, this process involves:

(a) preparing or providing a manufacturing composition based on water and a bleached or unbleached paper fiber pulp, a mechanical or a thermomechanical pulp or their mixtures, comprising, in ionic equilibrium, at least ions of alkali metals and/or earth alkali metals and ions of hydrogen carbonates, carbonates or silicates;

(b) adding to the manufacturing composition a mineral filler hydroxide to affix the mineral filler onto the paper fibers, and (c) forming a wet paper sheet on a papermaking machine based on the paper fibers which were loaded in this manner in suspension, and drying the sheet.

In an additional feature of the invention, the process furthermore includes:

(d) recovering the drip waters of stage (c) and injecting into them a gas containing carbon dioxide to stabilize their pH, and (e) recycling the waters processed in that manner into the manufacturing composition of stage (a).

In one advantageous feature of the invention, the manufacturing composition is based on pulp derived from old de-inked papers.

Other features and advantages of the invention are elucidated in the comprehensive description below relating to the single FIGURE and are illustrated in the attached drawing.

FIG. 1 shows a functional block diagram of a manufacturing process of the paper sheets of the invention.

Therefore, the invention is based on waters deriving from pulp or paper manufacture within the paper manufacturing process as a reservoir of ions and even of potentially precipitable mineral fillers.

In general, the waters present in a paper manufacturing process, for example a manufacturing suspension, will contain a large number of ions in ionic equilibrium. The most frequent ions are as follows: $H^+$, $OH^-$, $HCO_3^-$(hydrogen carbonate ions), $CO_{32}^{2-}$(carbonate ions), $(nSiO_2)O^{2-}$ (silicate ions), Na+(sodium ion), $Ca^{2+}$ calcium ion), and $Mg^{2+}$ (magnesium ion).

The waters used in the suspension also contain carbon dioxide either from atmospheric carbon dioxide or from underground water, i.e. phreatic layers, or industrial or recovered industrial carbon dioxide retrieved by chemical neutralization.

Accordingly, the waters in general will contain carbonates ($CO_3^{2-}$), hydrogen carbonates ($HCO_3^-$), and dissolved carbon dioxide, depending on the pH value.

The recycled or recovered waters from the papermaking process contain mineral ions. In the particular case of waters derived from a de-inking procedure, the sodium ions are prevalent and in the form of hydrogen carbonates when the intrinsic de-inking is carried out on the basis of carbon dioxide. In this case, the molar ratio of sodium ions to other alkali earth metal ions often is larger than 2. As a result, the sodium ion very actively takes part in the ionic equilibria.

In general, the aqueous cellulose fiber suspension from the papermaking process will contain:

between 20 and 1,000 ppm (parts per million) of sodium ions between 5 and 200 ppm of calcium ions, and between 5 and 200 ppm of magnesium ions.

In general, the cations are balanced by the presence of the hydrogen carbonate ions. This presence is measured by means of a full alkalimetric titer. The titer is between 2 and 30° F. The waters derived from de-inking old papers are characterized by a comparatively high titer because of the presence of a large quantity of sodium ions in equilibrium with the hydrogen carbonate ions.

Examples of the compositions of the aqueous cellulose fiber suspensions appropriate for the present invention are Listed below.

An aqueous fiber suspension derived from unused pulp and from underground waters exhibits the following composition:

20 to 100 ppm or more sodium ions, 8 to 20 ppm or more magnesium ions, 20 to 80 ppm or more calcium ions, 100 to 400 ppm or more carbon dioxide in dissolved form, carbonate ions and hydrogen carbonate ions.

An aqueous fiber suspensions made from de-inking exhibits the following composition:

150 to 250 ppm or more sodium ions, 20 to 80 ppm or more calcium ions, 8 to 20 ppm or more magnesium ions, 200 to 800 ppm or more dissolved carbon dioxide, carbonate ions and hydrogen carbonate ions.

The objective of the present invention is to use the ionic equilibria of the aqueous, cellulose fiber based suspension to affix mineral fillers onto the fibers by means of insolubilization or precipitation.

More specifically, the objective of the present invention uses the properties of the hydrogen carbonate ions of the alkali metals or earth alkali metals which, when in the presence of a calcium hydroxide (the sole reagent), react to form a calcium carbonate precipitate that affixes itself to the cellulose fibrils and fibers.

More specifically still, the present inventions objective is to use the hydrogen carbonate ions in equilibrium with the sodium ions and to a lesser extent with the calcium and magnesium ions to act as sources of carbonate ions ($Co_3^{2-}$) in order to attain precipitation by addition of calcium hydroxide of a complex which is substantially based on calcium carbonate.

The reactions include the following after calcium hydroxide addition when contact is made with the cellulose fibers:

$$2NaHCO_3+Ca(OH)_2+\text{fibers}\rightarrow Na_2CO_3+2H_2O+CaCO_3-\text{fibers} \quad (a)$$

$$Na_2CO_3+Ca(OH)_2\rightarrow 2NaOH+CaCO_3 \quad (b)$$

The secondary reactions below also can take place:

$$Ca(HCO_3)_2+Ca(OH)_2\text{fibers}\rightarrow 2H_2O+2CaCO_3-\text{fibers} \quad (c)$$

$$Mg(HCO_3)_2+2Ca(OH)_2\rightarrow Mg(OH)_2+2H_2O+2CaCO_3. \quad (d)$$

Other compounds also can precipitate in the form of silicates or metal carbonates depending on the kind of water being used and they shall affix to the fibers.

Calcium hydroxide is added in its soluble form or preferably in the form of highly concentrated milk of lime. This milk comprises calcium hydroxide particles having a mean diameter less than 6 microns.

The volume of calcium hydroxide added in the form of milk may be very slight with a ratio as low as 1 to 1,000 . This concentration makes it easy to integrate this stage in an in-line manner into the papermaking process and it is beneficial in spreading the crystals over all the fibers. Thanks to the nearly instantaneous reaction of this small volume with the fiber suspension, a high, temporary basicity takes place at the contact site with the fibers, enhancing chemical bonding of the precipitate onto the fibers.

Once the precipitation reaction is completed, the pH of the aqueous fiber suspension generally will have been modified and, moreover, the ionic conditions intrinsic to paper sheet formation will have changed. It may be necessary therefore to adjust the pH by neutralizing and by stabilizing it.

For that purpose, an acid such as of carbon dioxide is added to adjust the pH to the desired value. The precipitated compounds remain substantially unaffected thereby.

This addition of sodium dioxide also allows regenerating the alkali hydrogen carbonates. In this manner, the aqueous suspension will return to ionic equilibrium.

On an industrial scale, gases which contain carbon dioxide that was recovered from boiler combustion gases for example and, where called for, were enriched with pure carbon dioxide can be injected. When in an alkali medium, diluted carbon dioxide will react instantly.

The following reactions take place:

$$Na_2Co_3+H_2O+CO_2\rightarrow 2NaHCO_3, \quad (e)$$

$$2NaOH+Co_2\rightarrow Na_2CO_3+H_2O. \quad (f)$$

If the gas is added in excess, the following reactions will take place:

$$Mg(OH)_2+2CO_2\rightarrow Mg(HCO_3)_2 \quad (g)$$

$$Ca(OH)_2+2CO_2\rightarrow Ca(HCO_3)_2. \quad (h)$$

Together these reactions make it possible to stabilize the pH at the desired values.

Be it borne in mind that the sodium ions which are recycled with the waters from papermaking assume an essential function. In the first place, they provide hydrogen carbonate ions for the instantaneous precipitation of calcium carbonate (reaction "a") and then they instantaneously trap the hydrogen carbonate ions from the injected carbon dioxide (reaction "e") in order to stabilize the pH and to regenerate the ionic equilibria.

The method of the invention allows affixing many minerals to the fibers and recycling of the waters from the papermaking processes can be improved.

The invention moreover relates to a manufacturing process for sheets of paper, the process integrating into its essential stages one stage of affixing mineral fillers onto fibers in the manner described above.

This process is illustrated in the functional block diagram of FIG. 1.

A conventional process for manufacturing sheets of paper proceeds as follows:

preparing or providing a manufacturing composition based on water and on a chemical pulp of bleached or unbleached paper fibers, a mechanical or thermomechanical pulp, or their mixtures, and forming a sheet of paper by depositing the fibers on a mesh to constitute a layer of fibers which, in the case of cellulose cotton paper, next will be dried in a conventional manner on a heated or Yankee drum and then is creped, or it is dried by means of a cross-blowing procedure.

The initial manufacturing composition is at ionic equilibrium at least between alkali metal and/or earth alkali metal ions and hydrogen carbonate, carbonate or silicate ions.

Preferably, the initial manufacturing composition is at ionic equilibrium at least between hydrogen carbonate ions and earth alkali metal and sodium ions.

Following the preparation or supply stage of the manufacturing composition, the invention includes a stage during which a hydroxide of a mineral filler is added to affix this mineral filter onto the paper fibers before the sheet is formed.

Where called for in order to stabilize the manufacturing composition pH after the mineral filler has been affixed, a gas-containing carbon dioxide shall be injected.

This pH adjustment can take place in the aqueous fiber suspension wherein the mineral fillers are affixed to the fibers before the sheet forming stage.

On an industrial scale, however, this adjustment preferably takes place after the sheet has been formed, in the clean or drip waters recovered during the sheet-forming stage. These drip waters contain fine fibers and mineral fillers.

Next, the gas-containing carbon dioxide is injected into the drip water tank. The fibers then are recovered at a rate of about 5% and the ionically regenerated waters again contain hydrogen carbonate ions which are recycled at the rate of 95% into the initial manufacturing composition.

Accordingly, the stages relating to affixing the mineral fillers onto the fibers are integrated into the "in-situ" manufacturing procedure of paper sheets without equipment modification or additional setups.

As a result, the process of the invention is very advantageous and allows directly affixing mineral fillers onto the fibers in the course of the paper sheet manufacturing process.

The Examples below are Laboratory test results and illustrate the method affixing a mineral filler onto paper fibers when using aqueous solutions of different origins.

EXAMPLE 1

An aqueous cellulose fiber suspension is made from new fibers suspended in phreatic water.

100liters of the aqueous fiber suspension of the composition below are placed into a 100 Liter reactor: (ppm=parts per million)

| | |
|---|---|
| Fibers: | 2,300 ppm |
| Hydrogen carbonates: | 210 ppm |
| Calcium: | 60 ppm |
| Sodium: | 25 ppm |
| Magnesium: | 8 ppm |
| Dissolved carbon dioxide: | 5 ppm. |

The pH is approximately 8.

While agitating moderately, 100 g of milk of lime of 20% concentration or 20 g of $Ca(OH)_2$ or 10.8 g of calcium are then added. The calcium hydroxide particles mean diameters are less than 6microns. The pH stabilizes in less than 60 seconds at about 10.7.

Following precipitation, and ignoring the very slight dilution, the composition of the aqueous solution is as follows:

| | |
|---|---|
| Fibers: | 2,300 ppm |
| Calcium carbonates: | 305 ppm (affixed to the cellulose fibrils and fibers) |
| Hydrogen-carbonates/carbonates: | 25 ppm |
| Calcium: | 45 ppm |
| Sodium: | 25 ppm |
| Magnesium: | 5 ppm |
| Dissolved carbon dioxide: | traces. |

A sample is taken to make a paper form in a conventional manner (Franck form). Based on this suspension, forms can be made which are rich in affixed calcium carbonate. The observed retention rate is nearly 90% at a specific surface weight of 25 $g/m^2$, without adding any retention agent. Beyond 80 $g/m^2$, the retention rate approaches 100%. The form contains about 11.7% of calcium carbonate.

The pH may be adjusted to lower values by injecting a gas containing 10% or more of dissolved carbon dioxide into the suspension, by neutralizing the soda, magnesium hydroxide and the soluble calcium hydroxide.

Following injection of carbon dioxide to attain a pH of about 8, the composition of the aqueous solution is the following:

| | |
|---|---|
| Fibers: | 2,300 ppm |
| Calcium carbonates: | 325 ppm (affixed on the cellulose fibrils and fibers) |
| Hydrogen carbonates/carbonates: | 120 ppm |
| Calcium: | 40 ppm |
| Sodium: | 25 ppm |
| Magnesium: | 8 ppm |
| Dissolved carbon dioxide: | 30 ppm. |

In the same manner as above, forms can made which contain somewhat more fillers, about 12.5%, because the neutralized calcium did deposit on the fibers. Additional carbon dioxide injection allows removing the main initial quantities from the water, in particular calcium and hydrogen carbonate compositions.

EXAMPLE 2

An aqueous cellulose-fiber suspension is prepared from a suspension of fibers derived from recycling or de-inking old papers.

100 liters of the suspension of the following composition (ppm=parts per million) are placed in a 100 liter reactor:

| | |
|---|---|
| Fibers: | 2,300 ppm |
| Hydrogen carbonates: | 450 ppm |
| Calcium: | 60 ppm |
| Sodium: | 160 ppm |
| Magnesium: | 8 ppm |
| Dissolved carbon dioxide: | 20 ppm |

Under moderate agitation, 100 g of milk of lime concentrated at 20%, i.e. 20 g of $Ca(OH)_2$ or 10.8 of calcium are added. The mean diameter of the particles of calcium hydroxide in the milk of lime is Less than 6 microns.

The pH stabilizes in less than 60 seconds at about 9.8.

Following precipitation, and ignoring the very slight dilution, the composition of the aqueous solution is as follows:

| | |
|---|---|
| Fibers: | 2,300 ppm |
| Calcium carbonates: | 370 ppm (affixed on the cellulose fibrils and fibers) |
| Hydrogen carbonates/carbonates: | 250 ppm |
| Calcium: | 20 ppm |
| Sodium: | 160 ppm |
| Magnesium: | 5 ppm |
| Dissolved carbon dioxide: | traces. |

A sample is taken to make a paper form in the conventional manner (Franck form). Based on this suspension, forms can be manufactured which are rich in affixed calcium carbonate. A retention rate of nearly 90% is observed starting at a specific surface weight of 25 $g/m^2$ without adding any retention agent. Beyond 80 $g/m^2$, the retention rate approaches 100%. The form contains about 13.5% of calcium carbonate.

The pH may be adjusted to lower values by adding a gas containing 10% or more of carbon dioxide into the suspension, by neutralizing the alkali elements, in particular soda. EXAMPLE 3

An aqueous cellulose fiber suspension is prepared from a manufacturing composition containing the sodium hydrogen carbonate.

100 liters of the suspension exhibiting the following chemical composition (ppm=parts per million) are placed in a 100 Liter reactor:

| | |
|---|---|
| Fibers: | 2,280 ppm |
| Hydrogen carbonates: | 950 ppm |
| Calcium: | 65 ppm |
| Sodium: | 300 ppm |
| Dissolved carbon dioxide: | 5 ppm |

Thereupon and under moderate agitation, 100 g of milk of lime concentrated at 20%, that is 20 g of $Ca(OH)_2$ or 10.8 g of calcium are added.

The pH rapidly stabilizes near 8.8.

Following precipitation, and ignoring the very slight dilution, the aqueous suspension exhibits the following composition:

| | |
|---|---|
| Fibers: | 2,300 ppm |
| Calcium carbonates: | 420 ppm (affixed on the cellulose fibrils and fibers) |
| Hydrogen carbonates/carbonates: | 700 ppm |
| Calcium: | 3 ppm |
| Sodium: | 300 ppm |
| Dissolved carbon dioxide: | traces. |

A sample is taken to manufacture in conventional manner a paper form (Franck form). Based on this suspension, it is possible to manufacture forms and depending on the retention rate of the fine cellulose particles rich in affixed calcium carbonate, a retention rate for mineral fillers of nearly 90% is observed beginning at a specific surface weight of 25 $g/m^2$, without adding any retention agent. Beyond 80 $g/m^2$, the retention rate approaches 100%. The form contains about 15% calcium carbonate.

If a pH less than 8 is desired, carbon dioxide diluted in air up to 10% is injected. The carbon dioxide is recovered from the boiler's exhaust fumes. The carbon dioxide essentially reforms from the sodium hydrogen carbonate.

What is claimed is:

1. A method for affixing mineral fillers on cellulose fibers in an aqueous suspension comprising providing a reaction medium of an aqueous suspension of cellulose fibers, said suspension being derived from a papermaking procedure and containing hydrogen carbonates, carbonates or silicates of alkali and/or earth alkali metals, and adding a hydroxide of a mineral filler to said reaction medium to precipitate carbonates or silicates of the mineral filler onto the fibers, and wherein the aqueous suspension of cellulose fibers includes sodium hydrogen carbonates.

2. Method as claimed in claim 1, wherein the aqueous suspension of cellulose fibers includes calcium and/or magnesium-hydrogen carbonates.

3. Method as claimed in claim 2, wherein the aqueous suspension contains between 5 and 200 ppm calcium ions ($Ca^{2+}$) and/or between 5 and 200 ppm magnesium ions ($mg^2$+).

4. Method as claimed in either claim 1 or 2, wherein a total alkalimetric titer of the aqueous suspension is between 2 and 30° F.

5. Method as claimed in claim 1 wherein the aqueous suspension comprises between 20 and 1,000 ppm of sodium ions ($Na^+$).

6. A method for affixing mineral fillers on cellulose fibers in an aqueous suspension comprising providing a reaction medium of an aqueous suspension of cellulose fibers, said suspension being derived from a papermaking procedure and containing hydrogen carbonates, carbonates or silicates of alkali and/or earth alkali metals, and adding a hydroxide of a mineral filler to said reaction medium to precipitate carbonates or silicates of the mineral filler onto the fibers, and wherein the hydroxide of the mineral filler is a calcium hydroxide added in as a concentrated milk or in soluble form.

7. A Method as claimed in claim 6, wherein said milk comprises calcium hydroxide particles having a mean diameter of less than 6 microns.

8. A manufacturing process for sheets of paper comprising (a) providing a manufacturing composition based on water and on a bleached or unbleached chemical pulp of paper fibers, on a mechanical pulp, or on a thermomechanical pulp, or on a mixture thereof, said composition comprising at least alkali metal and/or earth alkali metal ions, and silicate or carbonate and hydrogen carbonate ions, (b) adding to said composition a hydroxide of a mineral filler to affix said mineral filler onto the paper fibers, and (c) forming a wet sheet of paper on a papermaking machine from the paper fibers which were precipitate-loaded in suspension and drying said sheet, wherein the manufacturing composition includes sodium and hydrogen carbonate ions in ionic equilibrium.

9. A manufacturing process for sheets of paper comprising (a) providing a manufacturing composition based on water and on a bleached or unbleached chemical pulp of paper fibers, on a mechanical pulp, or on a thermomechanical pulp, or on a mixture thereof, said composition comprising at least alkali metal and/or earth alkali metal ions, and silicate or carbonate and hydrogen carbonate ions, (b) adding to said composition a hydroxide of a mineral filler to affix said mineral filler onto the paper fibers, (c) forming a wet sheet of paper on a papermaking machine from the paper fibers which were precipitate-loaded in suspension and drying said sheet, (d) recovering drip waters of stage (c) and injecting into the drip waters a gas-containing carbon dioxide to neutralize and stabilize the pH of said drip waters, and (e) recycling the drip waters as processed in (d) into the manufacturing composition of (a), wherein the manufacturing composition includes sodium and hydrogen carbonate ions in ionic equilibrium.

* * * * *